US010280921B2

(12) United States Patent
Hou

(10) Patent No.: US 10,280,921 B2
(45) Date of Patent: May 7, 2019

(54) ROTARY FLUID MACHINERY AND METHOD FOR ELIMINATING AXIAL ROTOR DISPLACEMENT

(71) Applicant: JIANGSU FENGTAI FLUID MACHINERY TECHNOLOGY CO., LTD., Yancheng, Jiangsu (CN)

(72) Inventor: Xiaoli Hou, Yancheng (CN)

(73) Assignee: JIANGSU FENGTAI FLUID MACHINERY TECHNOLOGY CO., LTD., Yancheng (CN)

( * ) Notice: Subject to any disclaimer, the term of this patent is extended or adjusted under 35 U.S.C. 154(b) by 40 days.

(21) Appl. No.: 15/322,182

(22) PCT Filed: Jun. 24, 2014

(86) PCT No.: PCT/CN2014/080594
§ 371 (c)(1),
(2) Date: Dec. 27, 2016

(87) PCT Pub. No.: WO2015/196351
PCT Pub. Date: Dec. 30, 2015

(65) Prior Publication Data

US 2017/0152852 A1 Jun. 1, 2017

(51) Int. Cl.
*F01C 19/00* (2006.01)
*F03C 2/00* (2006.01)
(Continued)

(52) U.S. Cl.
CPC ..... *F04C 29/0021* (2013.01); *F04C 18/30* (2013.01); *F04C 18/46* (2013.01);
(Continued)

(58) Field of Classification Search
CPC ..... F04C 18/30; F04C 18/46; F04C 27/009; F04C 29/0021; F04C 29/02; F04C 29/12;
(Continued)

(56) References Cited

U.S. PATENT DOCUMENTS 2,150,122 A * 3/1939 Kollberg ..... F04C 2/3442 418/256
4,619,595 A * 10/1986 Amano ..... F01C 21/0809 418/259

(Continued)

FOREIGN PATENT DOCUMENTS

CN 2699009 Y * 5/2005 ..... F04C 2/344
CN 200971862 Y 11/2007

(Continued)

OTHER PUBLICATIONS

CN 2699009 Y—Wu Weidong—Self-priming Sliding Vane Pump—May 11, 2005—English Translation.*

(Continued)

*Primary Examiner* — Theresa Trieu
(74) *Attorney, Agent, or Firm* — Oliff PLC

(57) ABSTRACT

An externally-supported rotary fluid machinery and a method for eliminating axial rotor displacement. The fluid machinery includes a box body, an air cylinder and a rotor, wherein the rotor is eccentrically mounted in the air cylinder; the air cylinder is mounted in the box body; one end of a sliding plate is inserted in the rotor, and the other end is embedded in a wall of the air cylinder; a fluid inlet is provided on the box body, and a fluid outlet is provided on the air cylinder; a support end of the rotor protrudes out of the box body and is supported in a rotor bearing support structure; and a support end of the air cylinder also protrudes out of the box body and is supported in an air cylinder bearing support structure.

7 Claims, 3 Drawing Sheets

(51) Int. Cl.

| | |
|---|---|
| ***F03C 4/00*** | (2006.01) |
| ***F04C 29/00*** | (2006.01) |
| ***F04C 18/46*** | (2006.01) |
| ***F04C 27/00*** | (2006.01) |
| ***F04C 29/02*** | (2006.01) |
| ***F04C 29/04*** | (2006.01) |
| ***F04C 29/12*** | (2006.01) |
| ***F04C 18/30*** | (2006.01) |

(52) U.S. Cl.
CPC ..... *F04C 27/009* (2013.01); *F04C 29/02* (2013.01); *F04C 29/04* (2013.01); *F04C 29/12* (2013.01); *F04C 2240/20* (2013.01); *F04C 2240/30* (2013.01); *F04C 2240/50* (2013.01); *F04C 2240/60* (2013.01); *F04C 2240/603* (2013.01)

(58) Field of Classification Search
CPC .. F04C 29/04; F04C 2240/20; F04C 2240/30; F04C 2240/50; F04C 2240/60; F04C 2240/603
USPC ..... 418/104, 131, 133, 259
See application file for complete search history.

(56) References Cited

U.S. PATENT DOCUMENTS

| | | | | |
|---|---|---|---|---|
| 4,773,836 A | | 9/1988 | Moore | |
| 5,240,387 A | | 8/1993 | Nakajima et al. | |
| 5,700,140 A | * | 12/1997 | Gray ..... | F01C 21/0809 418/259 |

FOREIGN PATENT DOCUMENTS

| | | | |
|---|---|---|---|
| CN | 201144808 | Y | 11/2008 |
| CN | 101498306 | A | 8/2009 |
| CN | 201874828 | U | 6/2011 |

OTHER PUBLICATIONS

Jan. 20, 2015 Search Report issued in International Patent Application No. PCT/CN2014/080594.

* cited by examiner

ROTARY FLUID MACHINERY AND METHOD FOR ELIMINATING AXIAL ROTOR DISPLACEMENT

BACKGROUND

Technical Field

The present invention relates to rotary fluid machinery equipment, in particular to equipment capable of being used for synchronous rotation of a rotor and a cylinder body in the equipment such as a compressor, a fluid pump, a vacuum pump, a multiphase mixed transportation pump and the like, and specifically relates to an externally-supported rotary fluid machinery and a method for eliminating axial rotor displacement.

Related Art

At present, the rotary fluid machinery represented by a rotary compressor is very popular due to its small structural size, small wear, stable operation and low noise, for example, Chinese Patent ZL2008100067148 is a rotary compressor with a relatively ideal structure. Such compressor has the characteristic that an air cylinder and a rotor consist of two cylinders, a relative movement speed between which is very small, the air cylinder 2 is supported in a box body 1 through a bearing 16 so as to ensure flexible rotation of the cylinder 2, as shown in FIG. 1, due to communication with an air inlet cavity, the bearing is extremely easily polluted by a medium to affect the service life, due to the difficulty in sealing between the bearing and high temperature high pressure gas in an air outlet, the bearing is extremely easily affected by a high temperature high pressure fluid at an exhaust port to reduce the service life, a damage to the bearing is lethal for the rotary compressor, but there is no good solution at present, and the normal and long term operation of such equipment is severely influenced.

In addition, in the rotary compressor, since the rotor is subjected to the action of the pressure of a discharged medium (gas or liquid), the rotor is subjected to certain axial displacement, such that a distance between the end surface of the rotor and the end surface of the inner wall of the air cylinder is reduced, collision occurs or wear is aggravated under severe conditions, a traditional processing method is to increase a high pressure cavity at one end of the rotor, a high pressure introduced from a high pressure cavity is used to balance a thrust force, and such structure has the first problem that the complexity of the structure is increased and the second problem that since the attenuation of the introduced pressure is larger, a lethal effect is very easily caused after the efficacy is lost, in order to prevent such accidents, the current method is to increase a set of monitoring mechanism that prevents the aggravation of the wear due to overlarge axial movement, when a gap is smaller than a set value, the system is automatically cut off and halted and alarms, which greatly increases the manufacture cost and reliability, and there is no better solution for this problem yet.

SUMMARY

The present invention aims at the problem that the bearing of a support cylinder is not reasonable in configuration and axial gap compensation is large in difficulty in the existing rotary fluid machinery equipment, and designs a rotary fluid machinery in the form of a brand new support structure and rotor axial compensation, and also provides a method for eliminating the rotor axial displacement.

A first technical solution of the present invention is:

an externally-supported rotary fluid machinery, comprising a box body 1, an air cylinder 2 and a rotor 3, wherein the rotor 3 is eccentrically mounted in the air cylinder 2; the air cylinder is mounted in the box body 1; one end of a sliding plate 5 is inserted in the rotor 3, and the other end is embedded in a wall of the air cylinder; a fluid inlet 4 is provided on the box body 1, a fluid inlet is provided on a working section of the air cylinder, and a fluid outlet 6 is provided on a support section of the air cylinder; the machinery is characterized in that a support end of the rotor 3 protrudes out of the box body 1 and is supported in a rotor bearing support structure 7, and/or a support section of the air cylinder 2 (corresponding to a cylinder cover at one side) also protrudes out of the box body 1 and is supported in an air cylinder bearing support structure 8.

The rotor bearing support structure 7 is mounted in an airtight space formed by a shaft sealing structure to improve a lubrication cooling effect, and prevent a high pressure high temperature fluid from polluting a bearing and a lubricant in the rotor bearing support structure 7.

The air cylinder bearing support structure 8 is also mounted in the airtight space formed by the shaft sealing structure to improve a lubrication cooling effect, and prevent a high pressure high temperature fluid from polluting a bearing and a lubricant in the air cylinder bearing support structure 8.

The shaft sealing structure consists of a threaded sealing structure 9 and a shaft seal structure 18 which can reduce a high pressure generated during rotation.

Each of the rotor bearing support structure 7 and the air cylinder bearing support structure 8 consists of two bearings 12, a space ring 13 located between bearings, a sleeve 14 and an end sealing plate 15.

A second technical solution of the present invention is:

an externally-supported rotary fluid machinery, comprising a box body 1, an air cylinder 2 and a rotor 3, wherein the rotor 3 is eccentrically mounted in the air cylinder 2; the air cylinder is mounted in the box body 1; one end of a sliding plate 5 is inserted in the rotor 3, and the other end is embedded in a wall of the air cylinder; a fluid inlet 4 is provided on the box body 1, a fluid inlet is provided on a working section of the air cylinder, and a fluid outlet 6 is provided on a support section of the air cylinder; the machinery is characterized in that a support end of the rotor 3 protrudes out of the box body 1 and is supported in a rotor bearing support structure 7, and/or a support section of the air cylinder 2 also protrudes out of the box body 1 and is supported in an air cylinder bearing support structure 8; the support end of the rotor 3 is provided with a plane bearing 10 capable of eliminating the axial displacement and reducing and eliminating the wear between the end surface of the rotor and a cylinder end cover 11 of the air cylinder.

A third technical solution of the present invention is:

an externally-supported rotary fluid machinery, comprising a box body 1, an air cylinder 2 and a rotor 3, wherein the rotor 3 is eccentrically mounted in the air cylinder 2; the air cylinder is mounted in the box body 1; one end of a sliding plate 5 is inserted in the rotor 3, and the other end is embedded in a wall of the air cylinder; a fluid inlet 4 is provided on the box body 1, a fluid inlet is provided on a working section of the air cylinder, and a fluid outlet 6 is provided on a support section of the air cylinder; the machinery is characterized in that the support end of the rotor 3 is provided with a plane bearing 10 capable of eliminating the axial displacement and reducing and eliminating the wear between the end surface of the rotor and a cylinder end cover 11 of the air cylinder. The plane bearing structure is located on one end or two ends of mounting equipment.

A power input end is a rotor or air cylinder.

A fourth technical solution of the present invention is:

the application of one or both of an externally-supported structure capable of forming an independently sealed bearing working cavity and a plane bearing structure capable of eliminating axial displacement or application in a rotary compressor, a liquid pump, a vacuum pump and a multiphase mixed transportation pump.

A fifth technical solution of the present invention is:

A method preventing rotor axial displacement of a rotary fluid machinery is characterized in that by mounting a plane bearing on one end of the rotor outside the box body and by use of the counter-acting force of the plane bearing to counteract the axial push force applied to the rotor, a predetermined gap is maintained between the rotor and the inner end face of the air cylinder.

The present invention has the beneficial effects:

The present invention solves the difficult problem about the service life of a bearing of the rotary fluid machinery, and can ensure long term operation of the bearing from damage, the bearing mounted in a relative sealing structure can be prevented from being influenced by high temperature, high pressure and fluid impurities, a lubrication effect is ensured, the no-fault working period of the equipment can be greatly prolonged, and the reliability of the equipment is obviously prolonged. The service life of the bearing can be prolonged by more than 10 times.

By overcoming the technical prejudice, a traditional plane bearing is applied to the elimination of axial displacement, the elimination of the axial displacement is ensured from a mechanical structure, safety and reliability are realized, the structure is simple, and if a traditional monitoring mechanism is further arranged, no damage to the equipment due to the axial displacement can be ensured, and it also provide a guarantee for the early warning of the monitoring equipment.

The present invention has wide uses, can be widely applied to various rotary fluid machinery equipment such as a compressor, a fluid pump, a vacuum pump, a multiphase mixed transportation pump, and the like.

The present invention is favorable for improving a rotary speed of parts and increasing the displacement, such that manufacture of large-scale products is more portable.

DETAILED DESCRIPTION

The present invention is further explained in combination with drawings and embodiments.

Embodiment 1

Figure 1:
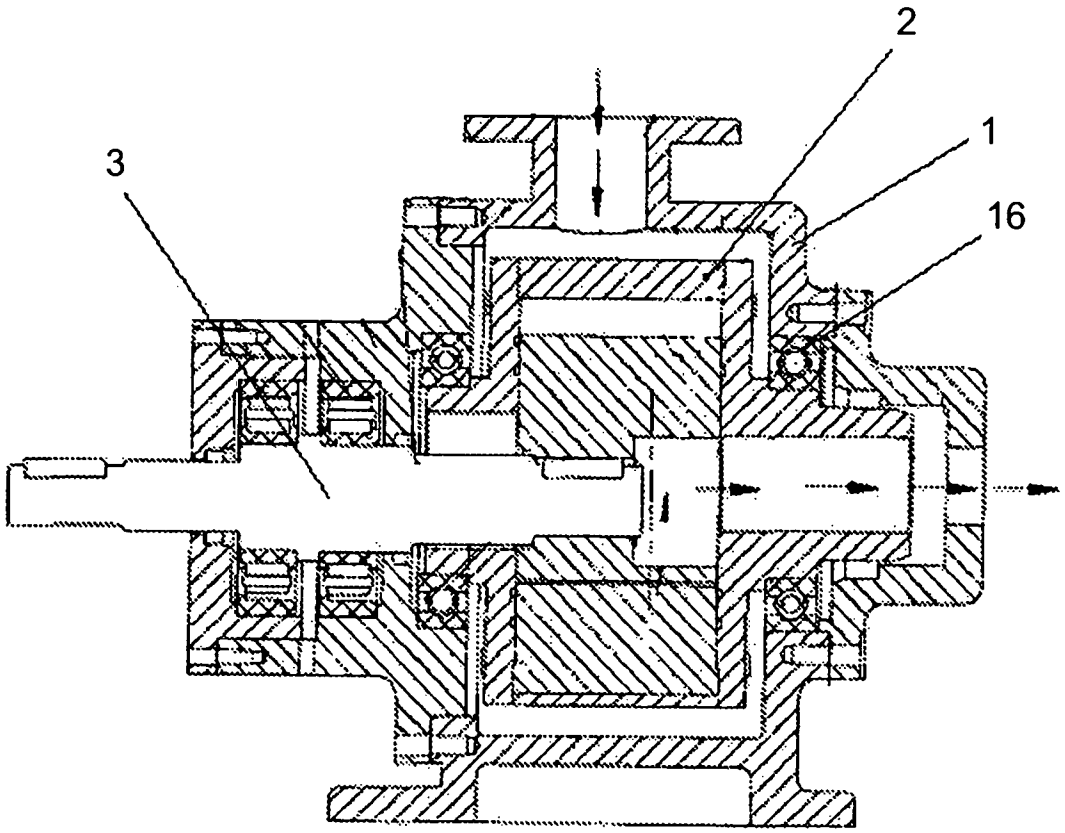
FIG. 1 Prior Art
FIG. 1 is a structural schematic diagram of an existing rotary compressor.
Figure 2:
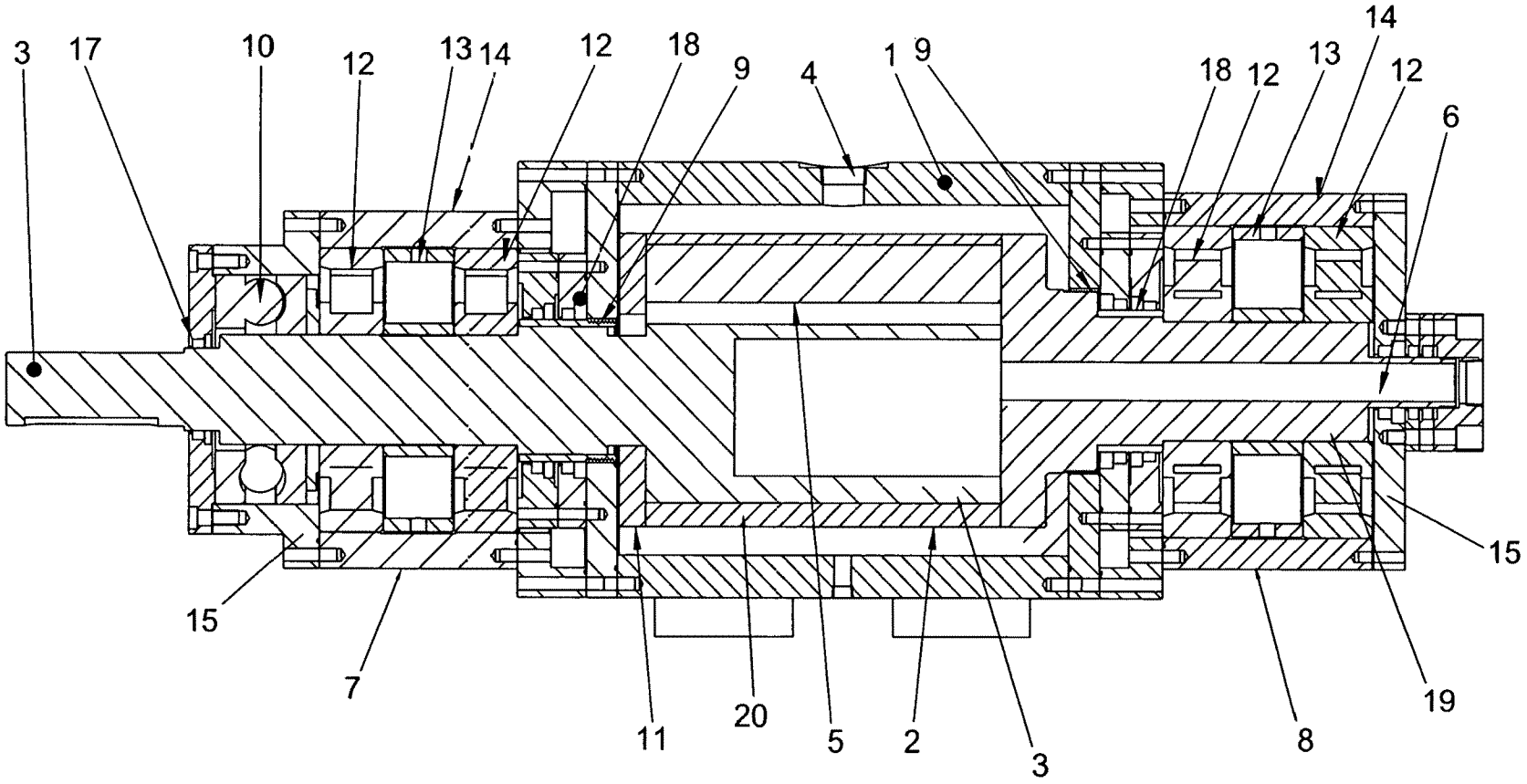
FIG. 2 is a structural schematic diagram of the present invention.

As show in FIG. 2

Figure 3:
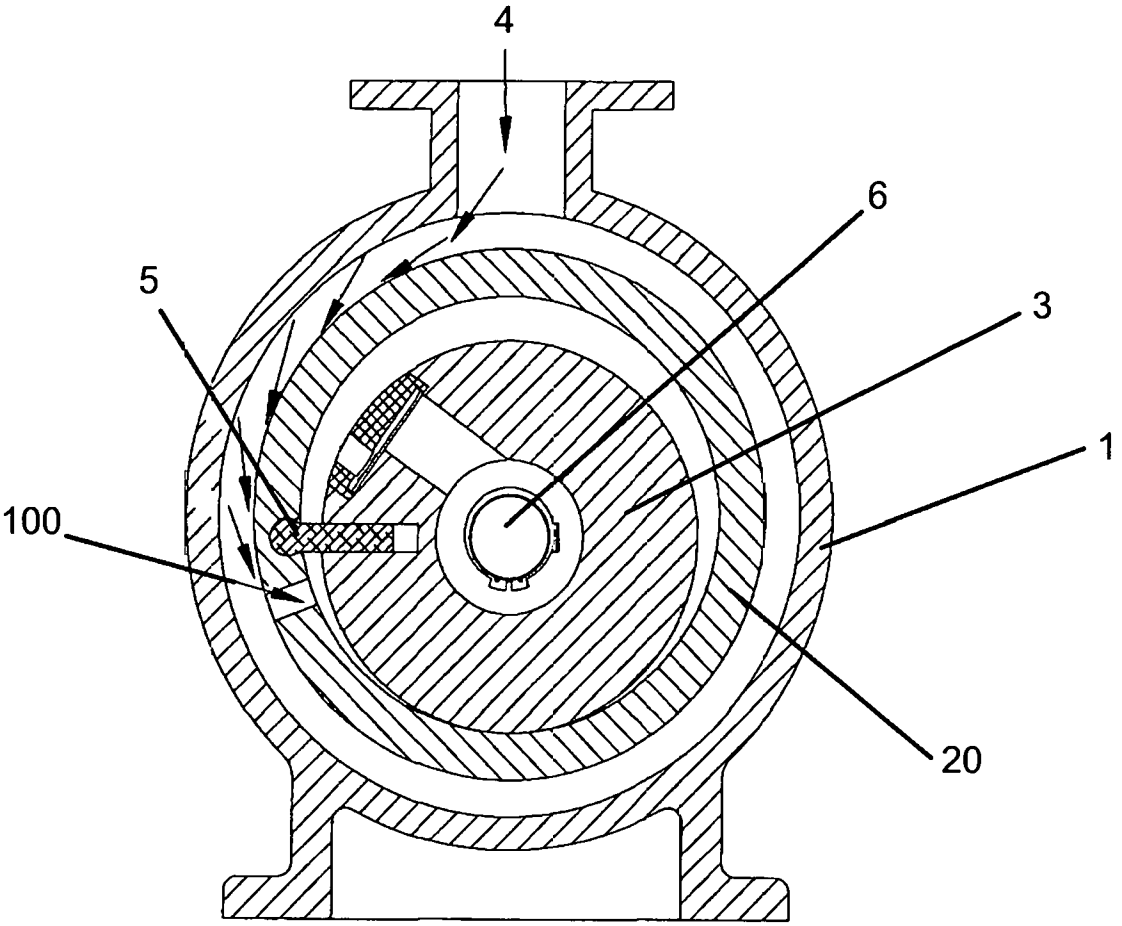
FIG. 3 is a structural schematic diagram showing the location of a fluid inlet.

An externally-supported rotary compressor (or one of a fluid pump, a vacuum pump and a multiphase mixed transportation pump) comprises a box body 1, an air cylinder 2 and a rotor 3, wherein the rotor 3 is eccentrically mounted in the air cylinder 2, a power end of the rotor 3 protrudes out of the box body and is connected to a drive prime motor (for example a motor), as shown in the left end in FIG. 2, the air cylinder is mounted in the box body 1, one end of a sliding plate 5 is inserted in the rotor 3, and the other end is embedded in a wall of the air cylinder; a fluid inlet 4 is provided on the box body 1, a fluid inlet 100 (see FIG. 3) is provided on a working section 20 of the air cylinder, and a fluid outlet 6 (air or liquid discharging port) is provided on a support section 19 of the air cylinder; a support end of the rotor 3 protrudes out of the box body 1 and is supported in a rotor bearing support structure 7, a support section of the air cylinder 2 also protrudes out of the box body 1 and is supported in an air cylinder bearing support structure 8. Each of the rotor bearing support structure 7 and the air cylinder bearing support structure 8 consists of two bearings 12, a space ring 13 located between bearings, a sleeve 14 and 5 an end sealing plate 15. As shown in FIG. 2, the rotor bearing support structure 7 and the air cylinder bearing support structure 8 are both mounted in an airtight space formed by a shaft sealing structure to improve a lubrication cooling effect, and prevent a high pressure high temperature fluid from polluting a bearing and a lubricant in the rotor bearing support structure 7 and in the air cylinder bearing support structure 8, and the leakage of a fluid at the inlet and compression leakage are also obstructed. During specific implementation, the shaft sealing structure consists of a threaded sealing structure 9 and a shaft seal structure 18 which can reduce a high pressure generated during rotation. During specific implementation, the externally-supported structure can also be provided on one side of the rotor or the air cylinder, and the other side is still supported in a traditional manner.

Embodiment 2

An externally-supported rotary compressor (or one of a fluid pump, a vacuum pump and a multiphase mixed transportation pump) comprises a box body 1, an air cylinder 2 and a rotor 3, wherein the rotor 3 is eccentrically mounted in the air cylinder 2, a power end of the rotor 3 protrudes out of the box body and is connected to a drive prime motor (for example a motor), as shown in the left end in FIG. 2, the air cylinder is mounted in the box body 1, one end of a sliding plate 5 is inserted in the rotor 3, and the other end is embedded in a wall of the air cylinder; a fluid inlet 4 is provided on the box body 1, a fluid inlet (not shown) is provided on a working section 20 of the air cylinder, and a fluid outlet 6 (gas or liquid) is provided on a support section 19 of the air cylinder; a support end of the rotor 3 protrudes out of the box body 1 and is supported in a rotor bearing support structure 7, a support section of the air cylinder 2 also protrudes out of the box body 1 and is supported in an air cylinder bearing support structure 8, and the support end of the rotor 3 is provided with a plane bearing 10 capable of eliminating the axial displacement and reducing and eliminating the wear between the end surface of the rotor and a cylinder end cover 11 of the air cylinder. Each of the rotor bearing support structure 7 and the air cylinder bearing support structure 8 consists of two bearings 12, a space ring 13 located between bearings, a sleeve 14 and an end sealing plate 15. As shown in FIG. 2, the rotor bearing support structure 7 and the air cylinder bearing support structure 8 are both mounted in an airtight space formed by a shaft sealing structure to improve a lubrication cooling effect, and prevent a high pressure high temperature fluid from polluting a bearing and a lubricant in the rotor bearing support structure 7 and in the air cylinder bearing support structure 8. During specific implementation, the shaft sealing structure consists of a threaded sealing structure 9 and a shaft seal structure 18 which can reduce a high pressure generated during rotation.

Embodiment 2 differs from embodiment 1 in that the plane bearing 10 capable of eliminating a rotor axial gap is increased, one end of the plane bearing abuts against a step surface of a rotor support end (rotor shaft), the other end of the plane bearing abuts against an end sealing plate 17, and the end sealing plate 17 is connected to the box body 1 through a connector. From FIG. 2, it can be seen that the plane bearing can ensure that the rotation of the rotor is not affected, the counter-acting force transmitted from the step surface can be counteracted, such that the rotor does not generate axial movement due to a stress.

Embodiment 3

An externally-supported rotary compressor (or one of a fluid pump, a vacuum pump and a multiphase mixed transportation pump) comprises a box body 1, an air cylinder 2 and a rotor 3, wherein the rotor 3 is eccentrically mounted in the air cylinder 2, a power end of the rotor 3 protrudes out of the box body and is connected to a drive prime motor (for example a motor), as shown in the left end in FIG. 2, the air cylinder is mounted in the box body 1, one end of a sliding plate 5 is inserted in the rotor 3, and the other end is embedded in a wall of the air cylinder; a fluid inlet 4 is provided on the box body 1, a fluid inlet (not shown) is provided on a working section 20 of the air cylinder, and a fluid outlet 6 is provided on a support section 19 of the air cylinder; a support end of the rotor 3 is provided with a plane bearing 10 capable of eliminating the axial displacement and reducing and eliminating the wear between the end surface of the rotor and a cylinder end cover 11 of the air cylinder, one end of the plane bearing abuts against a step surface of a rotor support end (rotor shaft), the other end of the plane bearing abuts against an end sealing plate 17, and the end sealing plate 17 is connected to the box body 1 through a connector. From FIG. 2, it can be seen that the plane bearing can ensure that the rotation of the rotor is not affected, the counter-acting force transmitted from the step surface can be counteracted, such that the rotor does not generate axial movement due to a stress.

Embodiment 3 differs from embodiment 2 in that mo matter the bearing supports the air cylinder is a traditional built-in from or an external form in embodiment 2, the plane bearing structure of the present embodiment can be singly adopted to eliminate an axial displacement gap of the rotor, that is to say, one plane bearing can be mounted on one end of the rotor outside the box body, a resilience force of the plane bearing is used to counteract an axial thrust force applied to the rotor, such that a predetermined gap is maintained between the rotor and the inner end face of the air cylinder.

During specific implementation, in embodiments 1-3 of the present invention, the rotor 3 can be an integral structure in FIG. 2, and can also be designed into a sectional combined structure, for example, the power input section and the working section are separately manufactured and then are combined into an integral structure. The air cylinder 2 can also be designed into a split structure, and the support section 19 (with an outlet passage) and the working section 20 in FIG. 2 are combined to form a complete air cylinder 2.

In addition, during specific implementation, the power input end can be changed into a cylinder support section from a rotor support section, and both of them have the same technical effect.

According to the difference of positions of shafts generating axial displacement, the plane bearing can be located on one or two ends of mounting equipment.

The above is merely part of optimal embodiments of the present invention, those skilled in the art can apply part or all of the independent bearing sealing support structure and the plane bearing to similar rotary equipment according to the revelation of the present invention, which are all considered to be within a protective range of the present invention.

Parts not involved in the present invention are same as the prior art or can be implemented by adopting the prior art.

What is claimed is:

1. An externally-supported rotary fluid machinery, comprising a box body, an air cylinder and a rotor, wherein:

the rotor is eccentrically mounted in the air cylinder;

the air cylinder is mounted in the box body;

one end of a sliding plate is inserted in the rotor, and the other end is embedded in a wall of the air cylinder;

a fluid inlet is provided on the box body;

a fluid inlet is provided on a working section of the air cylinder; and a fluid outlet is provided on a support section of the air cylinder, wherein a support end of the rotor protrudes out of the box body and is supported in a rotor bearing support structure, or a support section of the air cylinder also protrudes out of the box body and is supported in an air cylinder bearing support structure, and each of the rotor bearing support structure and the air cylinder bearing support structure consists of two bearings, a space ring located between the bearings, a sleeve and an end scaling plate.

2. The externally-supported rotary fluid machinery according to claim 1, wherein the rotor bearing support structure is mounted in an airtight space formed by a shaft sealing structure to improve a lubrication cooling effect, and prevent a high pressure high temperature fluid from polluting a bearing and a lubricant in the rotor bearing support structure.

3. The externally-supported rotary fluid machinery according to claim 1, wherein the air cylinder bearing support structure is mounted in an airtight space formed by the shaft sealing structure to improve a lubrication cooling effect, and prevent a high pressure high temperature fluid from polluting a bearing and a lubricant in the air cylinder bearing support structure.

4. The externally-supported rotary fluid machinery according to claim 2, wherein the shaft sealing structure consists of a threaded sealing structure and a shaft seal structure which reduces a high pressure generated during rotation.

5. The externally-supported rotary fluid machinery according to claim 1, wherein a power input end is a rotor or air cylinder.

6. The externally-supported rotary fluid machinery according to claim 1, wherein the externally-supported rotary fluid machinery is configured to apply of one or both of an externally-supported structure that forms an independently sealed bearing working cavity and a plane bearing structure that eliminates axial displacement in a rotary compressor, a liquid pump, a vacuum pump and a multiphase mixed transportation pump.

7. An externally-supported rotary fluid machinery, comprising a box body, an air cylinder and a rotor wherein:

the rotor is eccentrically mounted in the air cylinder;

the air cylinder is mounted in the box body;

one end of a sliding plate is inserted in the rotor, and the other end is embedded in a wall of the air cylinder;

a fluid inlet is provided on the box body;

a fluid inlet is provided on a working section of the air cylinder; and a fluid outlet is provided on a support section of the air cylinder, wherein a support end of the rotor protrudes out of the box body and is supported in a rotor bearing support structure; or a support section of the air cylinder also protrudes out of the box body and is supported in an air cylinder bearing support structure, wherein the support end of the rotor is provided with a plane bearing configured to eliminate the axial displacement and reduce and eliminate the wear between the end surface of the rotor and a cylinder cover of the air cylinder; and each of the rotor bearing support structure and the air cylinder bearing support structure consists of two bearings, a space ring located between the bearings, a sleeve and an end sealing plate.

* * * * *